US010316847B2

(12) United States Patent
Geffert

(10) Patent No.: US 10,316,847 B2
(45) Date of Patent: Jun. 11, 2019

(54) PUMP

(71) Applicant: Dr. Ing. h.c. F. Porsche Aktiengesellschaft, Stuttgart (DE)

(72) Inventor: Thomas Geffert, Freiberg am Neckar (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 464 days.

(21) Appl. No.: 15/091,892

(22) Filed: Apr. 6, 2016

(65) Prior Publication Data

US 2016/0319819 A1 Nov. 3, 2016

(30) Foreign Application Priority Data

Apr. 29, 2015 (DE) ..... 10 2015 106 671

(51) Int. Cl.

| | |
|---|---|
| ***F04D 15/00*** | (2006.01) |
| ***F01P 5/12*** | (2006.01) |
| ***F01P 7/14*** | (2006.01) |
| ***F04D 29/18*** | (2006.01) |
| ***F04D 29/52*** | (2006.01) |

(52) U.S. Cl.

CPC ..... *F04D 15/0022* (2013.01); *F01P 5/12* (2013.01); *F01P 7/14* (2013.01); *F04D 29/181* (2013.01); *F04D 29/528* (2013.01); *F01P 2007/146* (2013.01); *F05B 2240/30* (2013.01)

(58) Field of Classification Search

CPC .. F04D 15/0022; F04D 29/181; F04D 29/528; F01P 5/12; F01P 2007/146; F01P 7/14; F05B 2240/30

USPC ..... 251/48, 61, 61.1, 61.2, 61.3, 61.4, 61.5, 251/304, 315.01, 129.13

See application file for complete search history.

(56) References Cited

U.S. PATENT DOCUMENTS 3,580,268 A * 5/1971 Shafer ..... F16K 5/227 137/246.11
4,524,946 A * 6/1985 Thompson ..... F16K 5/0678 251/171
4,678,161 A * 7/1987 Bando ..... F16K 5/0626 251/171

(Continued)

FOREIGN PATENT DOCUMENTS

DE 197 17 691 10/1998
DE 698 08 600 6/2003

(Continued)

OTHER PUBLICATIONS

English Translation of Korean Office Action.

(Continued)

*Primary Examiner* — Aaron R Eastman
(74) *Attorney, Agent, or Firm* — Gerald E. Hespos; Michael J. Porco; Matthew T. Hespos

(57) ABSTRACT

A pump (1, 100) has a pump housing (2) with an intake opening (3) and an outlet opening (4). A drivable impeller (5) is arranged in the pump housing (2) and conveys a fluid from the intake opening (3) toward the outlet opening (4). A valve element (10) is provided in the pump housing (2) and can be set by an actuator (15, 115) to set the fluid flow that is conveyed by the pump (1, 100). The setting of the valve element (10) can be influenced by a magnetorheological braking element (17, 117).

10 Claims, 4 Drawing Sheets

(56) References Cited

U.S. PATENT DOCUMENTS

| | | | | |
|---|---|---|---|---|
| 4,815,701 | A * | 3/1989 | Stone | F16K 5/0636 251/174 |
| 4,842,244 | A * | 6/1989 | Panchison, Jr. | F16K 31/1635 251/26 |
| 4,846,532 | A * | 7/1989 | Friedow | B60T 8/4275 303/113.2 |
| 4,882,906 | A * | 11/1989 | Sekiyama | B60T 1/08 60/624 |
| 6,158,470 | A | 12/2000 | Ivers et al. | |
| 6,302,249 | B1 * | 10/2001 | Jolly | F15B 11/076 188/269 |
| 8,062,541 | B2 | 11/2011 | Barber et al. | |
| 9,574,485 | B2 | 2/2017 | Fournier et al. | |
| 2002/0011524 | A1 * | 1/2002 | Suzuki | B60H 1/03 237/19 |
| 2004/0194766 | A1 * | 10/2004 | Prior | F01C 11/008 123/559.1 |
| 2007/0209721 | A1 * | 9/2007 | Keiser | F16K 5/0605 137/625.46 |
| 2009/0014244 | A1 * | 1/2009 | Cavarello | B01D 35/12 184/6 |
| 2012/0145938 | A1 * | 6/2012 | Avdjian | F16K 5/0684 251/315.01 |
| 2012/0192816 | A1 | 8/2012 | Simon | |
| 2012/0248359 | A1 * | 10/2012 | Dederich | F16K 31/54 251/248 |
| 2015/0016966 | A1 | 1/2015 | Fournier et al. | |
| 2015/0016967 | A1 | 1/2015 | Fournier et al. | |
| 2015/0093240 | A1 | 4/2015 | Wickerath | |
| 2015/0226343 | A1 * | 8/2015 | Jenks | F17D 3/00 137/1 |
| 2016/0161008 | A1 * | 6/2016 | Webb | F16K 5/0673 251/315.01 |
| 2016/0222743 | A1 * | 8/2016 | Gosney | E21B 21/08 |

FOREIGN PATENT DOCUMENTS

| | | | |
|---|---|---|---|
| DE | 10 2005 021 850 | | 6/2006 |
| DE | 10 2005 050 542 | | 5/2007 |
| DE | 102007023858 | A1 | 11/2008 |
| DE | 102007034320 | A1 | 1/2009 |
| DE | 10 2010 005 731 | | 7/2011 |
| DE | 102010005731 | A1 | 7/2011 |
| DE | 102010050597 | A1 | 5/2012 |
| DE | 21 2009 000 182 | | 6/2012 |
| DE | 11 2011 101 949 | | 3/2013 |
| DE | 21 2012 000 085 | | 2/2014 |
| DE | 10 2013 007 332 | | 10/2014 |
| JP | S54098601 | U1 | 12/1952 |
| JP | 10077837 | A | 3/1998 |
| JP | 2009047051 | A | 3/2009 |
| KR | 1020110112509 | A | 10/2011 |
| WO | 2009018517 | A1 | 2/2009 |
| WO | 2010146609 | A1 | 12/2010 |
| WO | 2011101019 | A1 | 8/2011 |
| WO | 2013/120543 | | 8/2013 |
| WO | 2013120514 | A1 | 8/2013 |
| WO | 2013120543 | A1 | 8/2013 |

OTHER PUBLICATIONS

English Traslation of Chinese Office Action.
Korean Office Action dated Oct. 19, 2017.
German Search Report dated Oct. 2, 2015.
French Search Report dated Mar. 9, 2018.

* cited by examiner

PUMP

CROSS REFERENCE TO RELATED APPLICATION

This application claims priority under 35 USC 119 to German Patent Appl. No. 10 2015 106 671.8 filed on Apr. 29, 2015, the entire disclosure of which is incorporated herein by reference.

BACKGROUND

1. Field of the Invention

The invention relates to a pump, such as a water pump for a water circuit of a motor vehicle.

2. Description of the Related Art

Pumps, such as water pumps, are used in motor vehicles, for example, to supply a coolant circuit with a flow of water to cool the motor vehicle engine and possibly other assemblies. Water flows as coolant through the drive engine and is heated there. Subsequently, the coolant flows through a coolant radiator where it is cooled again in a heat exchange, for example, with air, before the coolant is conveyed to the drive engine again by the pump.

The pump need not always perform in the maximum range, and can be reduced depending on the operating state of the motor vehicle. The pump performance is dependent, however, on the drive. If the pump is driven by the drive engine itself, however, the speed of the pump is determined by the speed of the drive engine, which does not have to correlate with the required pump performance.

A controllable pump therefore is desired. Very complicated solutions tend to be unsuitable in automotive applications due to high costs.

DE 10 2010 005 731 A1 discloses a pump having a delivery element and a valve element arranged downstream thereof and configured as a slide or rotary slide. There is an ability to control the pump via actuating means, but intermediate positions cannot be set satisfactorily by every actuating means.

WO 2013/120543 A1 discloses a pump having a valve element downstream of an impeller. The valve can be adjusted between two end positions by a vacuum cell. As a result, however, satisfactory control is not achieved because the vacuum cell usually cannot be moved satisfactorily into intermediate positions and held there.

It is the object of the invention to provide a pump that is of simple and inexpensive construction and nevertheless permits good control.

SUMMARY

The invention relates to a pump having a pump housing with an intake opening and an outlet opening. A drivable impeller is arranged in the pump housing and enables a fluid to be conveyed from the intake opening toward the outlet opening. A valve element is provided in the pump housing and can be set by an actuator to set the fluid flow that is conveyed by the pump. The setting of the valve element can be influenced by a magnetorheological braking element. As a result, the valve element can advantageously be set reliably in every operating position and also for a predefined time period by the controllable interaction of actuator and braking element, even if the actuator tends merely to be capable of being set briefly or unstably in intermediate positions.

The actuator for setting the valve element may be a pressure or vacuum actuator. The actuator can thus be a hydraulic or pneumatic actuator that can be loaded with pressure or with a vacuum to adjust or set the valve element. Actuators of this type are actuable between two end positions, and can be set briefly at intermediate positions.

The actuator may be a vacuum cell. Vacuum cells of this type can be manufactured simply and inexpensively and are therefore readily used, in particular, in automotive engineering.

The valve element may be arranged rotatably in the housing. As a result, a type of rotary slide or rotary valve can be formed and can simply control the conveyed fluid flow from a maximum fluid flow to a minimum fluid flow with a rotation of approximately 90°. The maximum fluid flow can be the fluid flow that the pump can convey at most and the minimum fluid flow can, for example, be a fluid flow of zero if the valve element interrupts the fluid flow completely. An intermediate position can correspond to a fluid flow between the maximum fluid flow and the minimum fluid flow.

The actuator may have a substantially linearly adjustable output element that acts via an actuating mechanism on the valve element that is arranged rotatably in the housing. As a result, a rotational movement of the valve element can be brought about via an actuator of simple configuration. A simple actuator is not expensive, but nevertheless brings about reliable control because the setting of the valve element is performed simply. The actuating mechanism may be a lever mechanism. As a result, the actuator can be articulated simply and reliably on the valve element, and secure articulation can be achieved over the service life nevertheless.

The magnetorheological braking element may be connected to the valve element and may act on the valve element. As a result, a direct action of the braking element can be transmitted to the valve element to bring about a rapid and direct action without external influences.

The magnetorheological braking element may be connected to the actuating mechanism and may act on the actuating mechanism. As a result, the magnetorheological braking element can be integrated simply into the actuating mechanism, while achieving installation space advantages and simplified assembly.

The magnetorheological braking element may act upon the output element of the actuator to provide a structural unit that can be assembled satisfactorily and can be manufactured simply and inexpensively.

The valve element may be mounted rotatably in the housing, and the magnetorheological braking element may act on a side of the valve element opposite the actuator. As a result, a satisfactory division of installation space can be achieved by mounting the two elements that act on the valve element on opposite sides of the housing.

In the following text, the invention will be explained in detail using one exemplary embodiment with reference to the drawing.

DETAILED DESCRIPTION

Figure 1:
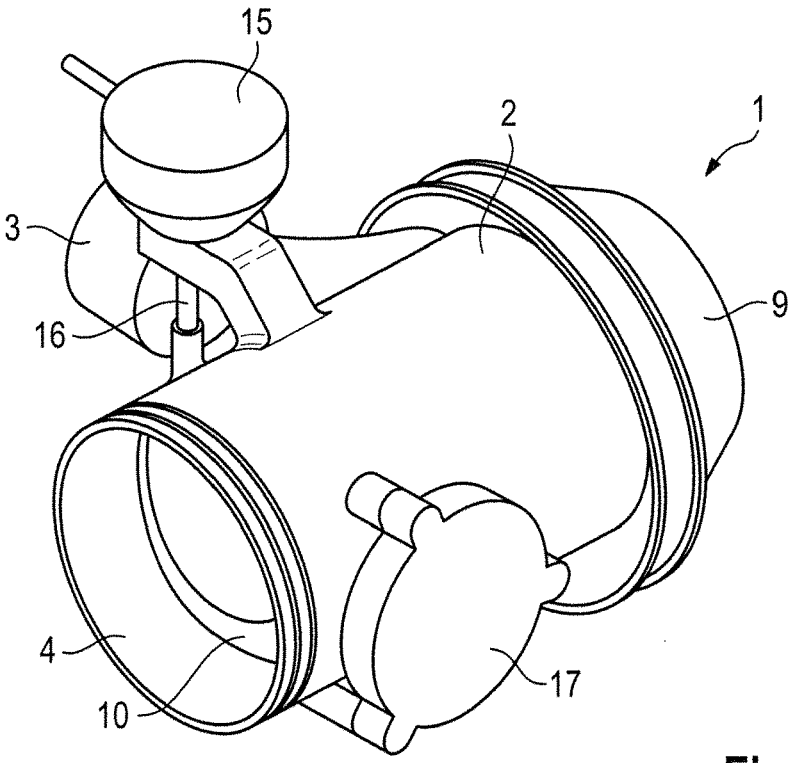
FIG. 1 is a diagrammatic, perspective illustration of one embodiment of a pump according to the invention.
Figure 2:
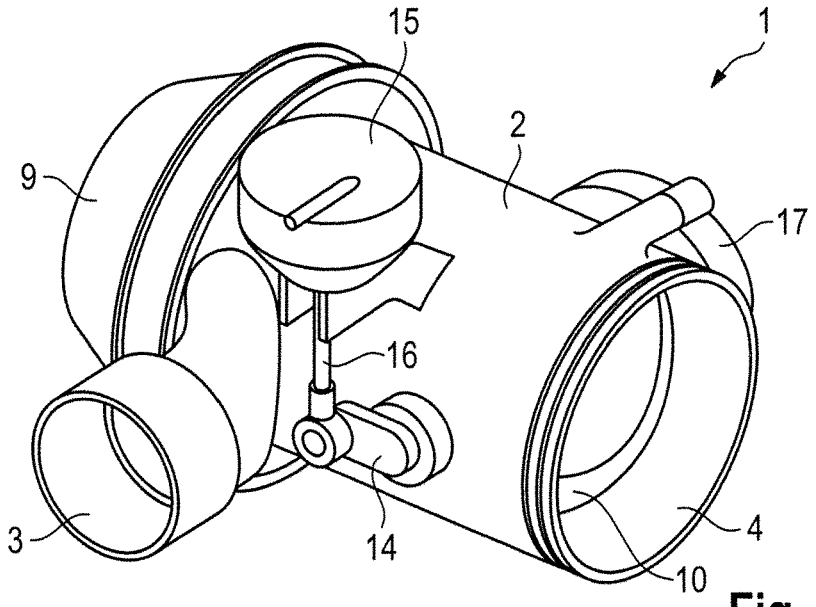
FIG. 2 is a further illustration of the pump of FIG. 1.
Figure 3:
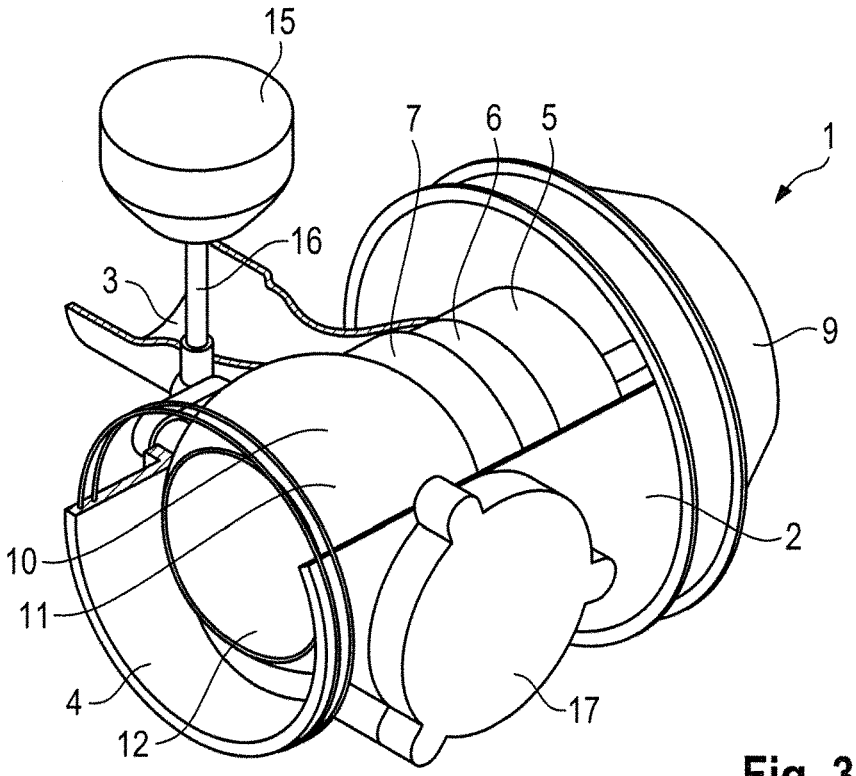
FIG. 3 is a partially sectioned illustration of the pump according to FIG. 1.
Figure 4:
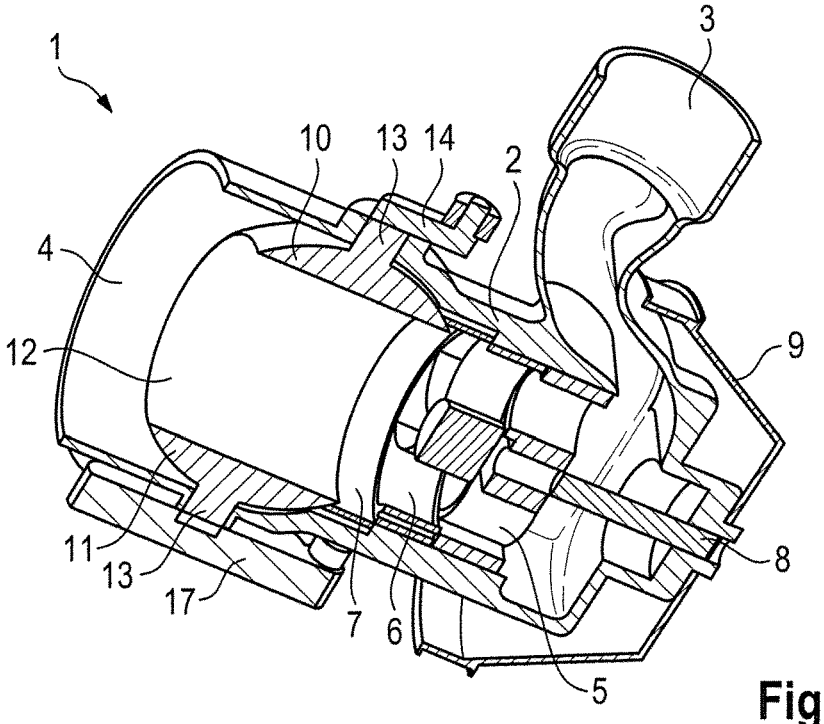
FIG. 4 is a sectional view of the pump according FIG. 1.

FIGS. 1 to 4 show an embodiment of a coolant or water pump 1 for a motor vehicle. The pump 1 has a pump housing 2 with an intake opening 3 and an outlet opening 4. As an alternative, the pump housing 1 can have more than one intake opening 3 and/or more than one outlet opening 4. In the exemplary embodiment of FIGS. 1 to 4, the pump housing is partially of approximately tubular configuration, with the outlet opening 4 being configured as a tube opening in the longitudinal direction of the tubular part of the pump housing 2. The intake opening 3 is a tube stub that extends approximately radially toward and connects to the tubular part of the pump housing 2.

An impeller 5 is arranged within the pump housing 2 and is followed in the axial direction by a compression stage 6 and a sealing body 7. The impeller 5 advantageously is configured as a fan wheel. The impeller 5 is received on a shaft 8 that is mounted rotatably in the pump housing 2. The shaft 8 protrudes in the axial direction out of the pump housing 2 and is connected to a pulley wheel 9. The pulley wheel 9 is drive-connected to a belt (not shown) of a belt drive, so that the impeller 5 in the pump housing 2 can be driven.

The impeller 5 conveys a fluid, such as water or coolant, from the intake opening 3 toward the outlet opening 4. The delivery quantity of the pump 1 depends on the drive performance or the drive speed for driving the impeller.

A valve element 10 is provided to further control the pumped fluid volume flow. The valve element 10 is arranged downstream of the impeller 5 in the tubular part of the pump housing 2. The valve element 10 is a rotary slide that has an approximately spherical form 11 radially on the outside, and a through channel 12 is formed therethrough. The valve element 10 is mounted rotatably in the housing by two pins 13. As a result, the through channel 12 can be released so that the conveyed volume flow is at a maximum, or the through channel 12 is closed so that no volume flow is conveyed. Intermediate positions also are possible so that the volume flow can be varied. The valve element 10 is arranged downstream of the sealing body 7 to bring about a sealing action between the pump housing 2 and the valve element 10 if the valve element 10 is set with a closed through channel 12.

The valve element 10 is influenced from the outside via the two pins 13. The rotation of the valve element 10 can be performed via a lever 14 at the one pin 13. To this end, an actuator 15 is provided and is configured as a vacuum cell in the exemplary embodiment of FIGS. 1 to 4. The actuator 15 has a longitudinally displaceable output element 16, such as a tappet, that is connected to the lever 14 to rotate the valve element 10. The output element 16 is displaced and the valve element 10 is adjusted by supplying the vacuum element with vacuum.

As an alternative, the actuator 15 can be configured as a pressure or vacuum actuator or as a pneumatic or hydraulic actuator here.

The setting of the valve element 10 is therefore performed by the actuator 15.

A braking element 17, such as a magnetorheological braking element 17, is provided on the other pin 13 for influencing the movement of the valve element 10. The movement can also be fixed so that the valve element 10 can be blocked in one position.

The braking element 17 has a housing in which a magnetorheological material is received. A piston-like element also is provided in the housing. The piston-like element moves through the magnetorheological material when the pin 13 moves. If a defined magnetic field then is applied, the elements of the magnetorheological material are linked and the viscosity of the magnetorheological material increases. This leads to an action of force on the piston-like element, and the movement of the valve element 10 experiences a braking force. The braking force is dependent on the magnetic field that is applied. This can lead to blocking of the movement of the valve element 10.

The magnetorheological material can be a dry powder or a fluid in which magnetorheological elements are received.

The position of the valve element 10 in the pump housing 2 is therefore controlled in the interaction of the actuator 15 with the braking element 17.

FIGS. 1 to 4 show an actuator 15 with a substantially linearly adjustable output element 16 that acts via the lever 14 as an actuating mechanism on the valve element 10 that is arranged rotatably in the pump housing 2. As an alternative, other actuating mechanisms also can be provided.

The magnetorheological braking element 17 is connected directly to the valve element 10 and therefore also acts directly on the valve element 17. As an alternative, the magnetorheological braking element 17 could be connected to and act on the actuating mechanism to control the position of the valve element.

Figure 5:
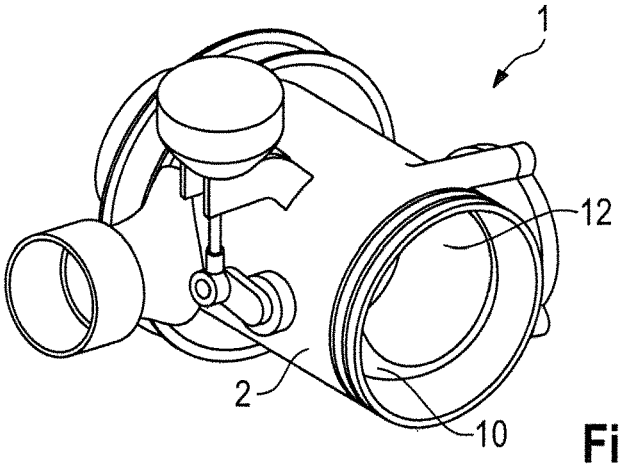
FIG. 5 is a perspective view of a pump with a completely open valve element.
Figure 6:
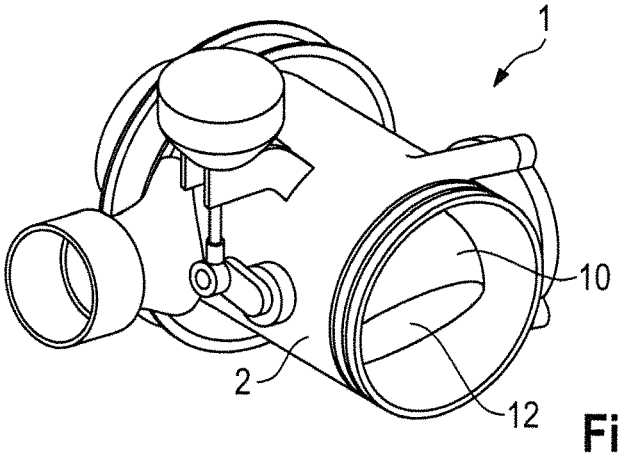
FIG. 6 is a perspective view of a pump with a valve element that is only partially open.
Figure 7:
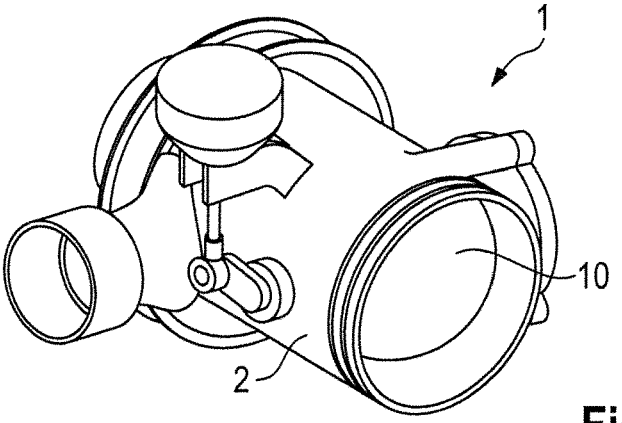
FIG. 7 is a perspective view of a pump with a completely closed valve element.

FIGS. 5 to 7 show the pump 1 from FIGS. 1 to 4 in different operating positions. In FIG. 5, the valve element 10 is set so that the through channel 12 is free. The fluid volume flow that can be conveyed is not influenced or reduced as a result. In FIG. 6, the valve element 10 is set so that the through channel 12 is released only proportionately. Thus, the fluid volume flow that can be conveyed is reduced. In FIG. 7, the valve element 10 is set so that the through channel 12 is blocked completely. Thus, the fluid volume flow that can be conveyed is interrupted as a result.

Figure 8:
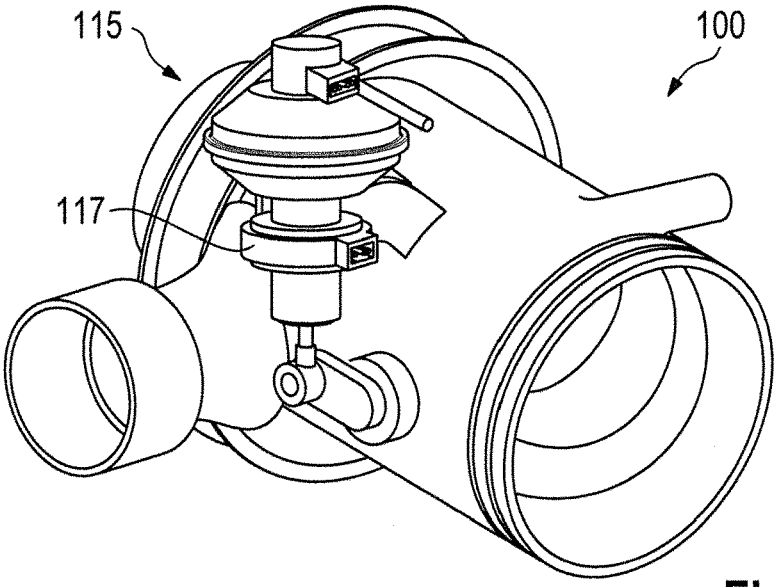
FIG. 8 is perspective view of a further embodiment of a pump according to the invention.

FIG. 8 shows an embodiment of a pump 100, in which the braking element 117 is integrated into the actuator 115. Otherwise, the pump 100 is identical to the pump 1 from FIGS. 1 to 4, so that a repetition in this regard is superfluous.

Figure 9:
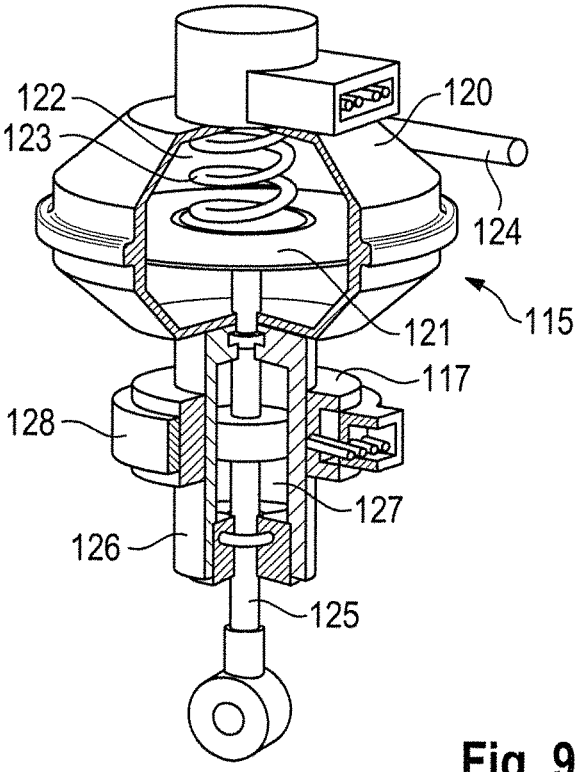
FIG. 9 is a perspective view, partly in section, of a vacuum cell with a magnetorheological braking element as actuator for setting the valve element of the pump of FIG. 8.

FIG. 9 shows the actuator 115 in this regard. The actuator 115 has a housing 120 with a diaphragm 121 arranged therein and defines a pressure space 122 together with the housing 120 that can be loaded with pressure or vacuum via a connector 124.

A tappet 125 is connected as an output element to the diaphragm 121, with the result that the tappet can be displaced in the case of pressure or vacuum loading in the pressure space 122. A spring 123 also is provided in the pressure space 122 and loads the tappet with force. If no pressure or vacuum prevails, the spring loads the tappet into a defined position that is known as a fail-safe position.

The braking element 117 is provided on the actuator 115 and has a housing 126 with a chamber 127 in which a magnetorheological material is received. A piston-like element which moves through the magnetorheological material is provided in the chamber 127 and is connected to the tappet 125. A magnetic field generating means 128 applies a magnetic field to change the viscosity of the magnetorheological material and hence to control the position of the tappet 125 as output element in interaction with the pressure or vacuum loading.

LIST OF DESIGNATIONS

1 Pump
2 Pump housing
3 Intake opening
4 Outlet opening
5 Impeller
6 Compression stage
7 Sealing body
8 Shaft
9 Pulley wheel
10 Valve element
11 Spherical form
12 Through channel
13 Pin
14 Lever
15 Actuator
16 Output element, tappet
17 Braking element
100 Pump
115 Actuator
117 Braking element
120 Housing
121 Diaphragm
122 Pressure space
123 Spring
124 Connector
125 Output element, tappet
126 Housing
127 Chamber
128 Magnetic field generating

What is claimed is:

1. A pump comprising: a pump housing with an intake opening and with an outlet opening, a drivable impeller arranged in the pump housing and being operative to convey a fluid from the intake opening toward the outlet opening, a valve element rotatably provided in the pump housing and having at least one pin defining an axis about which the valve element is rotatable for controlling a fluid flow that is conveyed by the pump, an actuator for setting a rotatable position of the valve element so that the valve element can control the fluid flow that is conveyed by the pump, and a magnetorheological braking element that includes a magnetorheological material that is in contact with the pin and when activated influences the setting of the valve element.

2. The pump of claim 1, wherein the actuator is a pressure or vacuum actuator configured to set the valve element.

3. The pump of claim 2, wherein the actuator is a vacuum cell.

4. The pump of claim 1, wherein the actuator has a substantially linearly adjustable output element that acts via an actuating mechanism on the valve element.

5. The pump of claim 4, wherein the actuating mechanism is a lever mechanism.

6. The pump of claim 1, wherein the magnetorheological braking element is connected to the valve element and acts on the valve element.

7. The pump of claim 1, wherein the valve element is mounted rotatably in the valve housing, the magnetorheological braking element acts on the pin of the valve element on a side of the valve element opposite to the actuator.

8. A pump comprising: a pump housing with an intake opening and with an outlet opening, a drivable impeller arranged in the pump housing and being operative to convey a fluid from the intake opening toward the outlet opening, a valve element rotatably provided in the pump housing and having at least one pin defining an axis about which the valve element is rotatable for controlling a fluid flow that is conveyed by the pump, a lever fixed to the pin and disposed external of the pump housing, an actuator having a longitudinally displaceable output element connected to a position on the lever spaced from the pin, the output element of the actuator being movable for setting a rotatable position of the valve element so that the valve element can control the fluid flow that is conveyed by the pump, and a magnetorheological braking element that includes a magnetorheological material that is in contact with the longitudinally displaceable output element and when activated influences the setting of the valve element.

9. The pump of claim 8, wherein the actuator is a pressure or vacuum actuator configured to set the valve element.

10. The pump of claim 9, wherein the actuator is a vacuum cell.

* * * * *